US009919203B1

(12) United States Patent
Tseng

(10) Patent No.: US 9,919,203 B1
(45) Date of Patent: Mar. 20, 2018

(54) MAHJONG TILE

(71) Applicant: Tzu-Hsiang Tseng, Taichung (TW)

(72) Inventor: Tzu-Hsiang Tseng, Taichung (TW)

( * ) Notice: Subject to any disclaimer, the term of this patent is extended or adjusted under 35 U.S.C. 154(b) by 12 days.

(21) Appl. No.: 15/253,879

(22) Filed: Sep. 1, 2016

(51) Int. Cl.
*A63F 1/00* (2006.01)
*A63F 9/20* (2006.01)
*A63F 9/24* (2006.01)

(52) U.S. Cl.
CPC ..... *A63F 9/20* (2013.01); *A63F 9/24* (2013.01); *A63F 2009/205* (2013.01)

(58) Field of Classification Search
CPC ..... A63F 9/20; A63F 9/24; A63F 2009/205
USPC ..... 273/292, 150, 148 A
See application file for complete search history.

(56) References Cited

U.S. PATENT DOCUMENTS 4,900,027 A * 2/1990 Sheridan ..... A63F 1/18 273/292
5,211,403 A * 5/1993 Ostrander ..... A44C 21/00 273/288
5,676,376 A * 10/1997 Valley ..... A44C 21/00 273/148 R
6,508,466 B1 * 1/2003 Rendleman ..... G07F 1/06 264/246
7,575,235 B2 * 8/2009 Belill ..... A63F 1/06 273/292
8,382,579 B2 * 2/2013 Yoshida ..... G06K 7/10 273/148 R
2009/0069083 A1 * 3/2009 Okada ..... A63F 13/00 463/31

FOREIGN PATENT DOCUMENTS

CN 205903613 U * 1/2017

* cited by examiner

*Primary Examiner* — Vishu Mendiratta
(74) *Attorney, Agent, or Firm* — Raymond Y. Chan; David and Raymond Patent Firm

(57) ABSTRACT

A mahjong tile includes a main body, a cover, a magnet, an induction chip, and a transparent board. The main body has a chip trough at an inner side thereof, connecting poles protruding from a top surface thereof, and a tile face trough at a bottom thereof. The cover corresponds to the main body and has connecting holes and an accommodation trough at a bottom thereof. The magnet is accommodated in the accommodation trough. Upper and lower ends of the magnet are magnet poles of the magnet. The induction chip is for a sensor to read the suite and numeric of the mahjong tile. The magnet of the mahjong tile supplies magnetism, enabling the mahjong tile to be delivered for playing a computer game with the amusement of the real mahjong tile. This can prevent the players from touching the tiles and increase the fairness of the game.

6 Claims, 6 Drawing Sheets

MAHJONG TILE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a mahjong tile, and more particularly to a mahjong tile having a magnet and an induction chip therein.

Description of Related Arts

There are two types of mahjong games on the market, one with real mahjong tiles and the other with virtual mahjong tiles. The real mahjong tile is made of plastics and has a three-dimensional shape. The bottom surface of the real mahjong tile is printed or etched with a suite and a numeric of the mahjong tile. When playing a game, the players first shuffle and stack the mahjong tiles on a mahjong table in preparation for the game, and then take the required tiles for playing the game. These days, a variety of game machines and online game software are developed. A screen is used to show the process of the game. Through a keyboard, buttons or operation interfaces, the players manipulate a computer game. In addition to the rules of the traditional mahjong game, the game machines and online game software also provide a lot of sound and light effects to increase the fun of the game. However, the foregoing games have the following drawbacks.

1. The players directly touch the real mahjong tiles. Some players may have the intent to cheat in the game by marking the mahjong tiles when shuffling or taking the mahjong tiles. The players mistrust each other, each with his own axe to grind. Although the game is fun, the justice and fairness of the game may be challenged.

2. Virtual mahjong tiles can prevent the players from touching the tiles, but this way has lost the reality of the mahjong tiles. The greatest pleasure of the mahjong game is that the players can shuffle, stack and take the tiles before the game. For a virtual mahjong game, the tiles are controlled and output by the software. This deprives the players of their amusement and excitement to take the tiles. Thus, the mahjong tiles need to be improved. Accordingly, the inventor of the present invention has devoted himself based on his many years of practical experiences to solve this problem.

SUMMARY OF THE PRESENT INVENTION

In view of the problems and drawbacks of the prior art, the inventor of the present invention has devoted himself based on his many years of practical experiences to provide an improved mahjong tile. The primary object of the present invention is to provide a mahjong tile having a magnet and an induction chip therein. The mahjong tile can be taken out at random by means of magnetism for playing a game. The induction chip is for a sensor to read the suite and numeric of the mahjong tile. This can prevent the players from touching the tiles and increase the fairness of the game.

Detailed Description of the Preferred Embodiment

Figure 1:
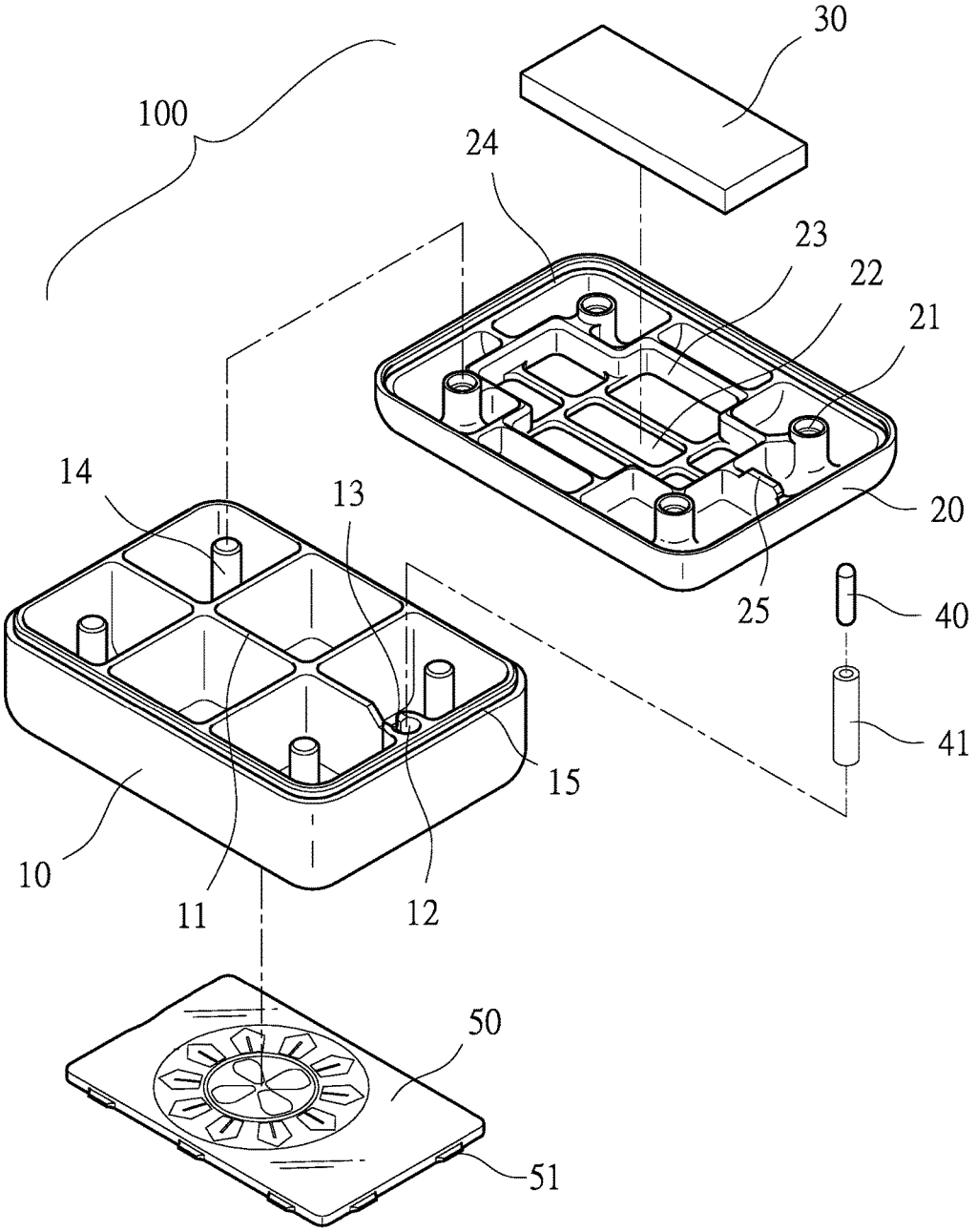
FIG. 1 is an exploded view of the present invention.
Figure 2:
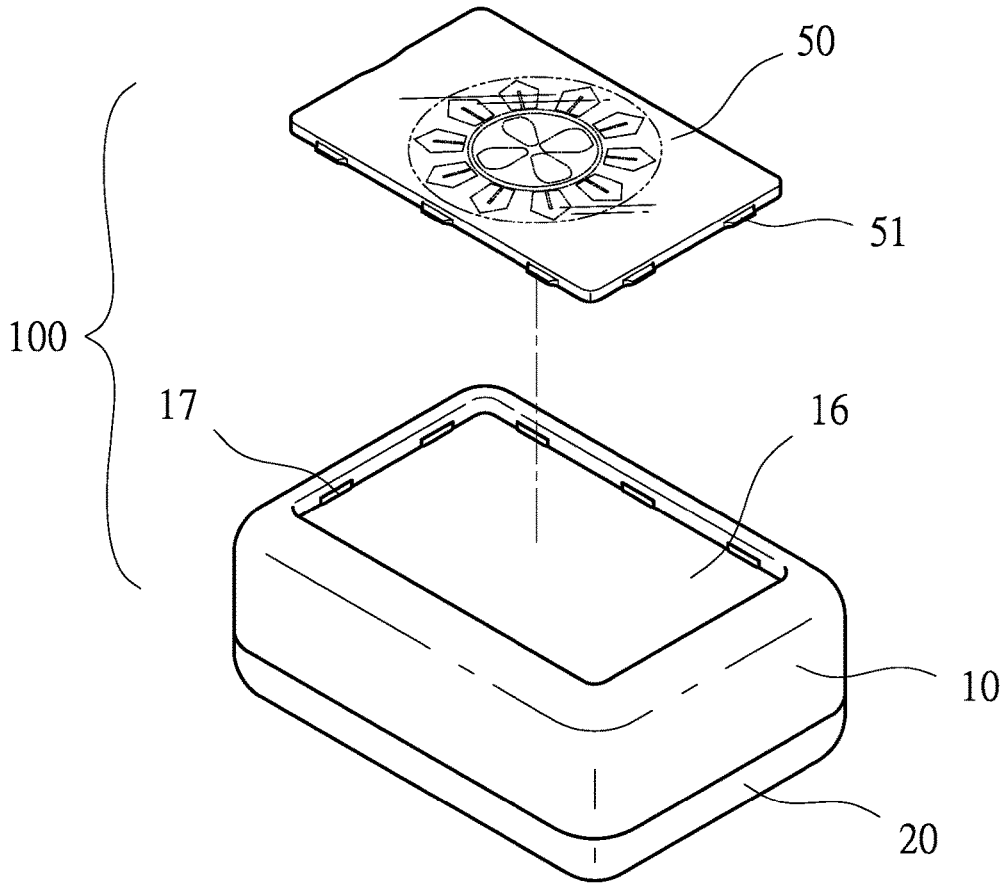
FIG. 2 is an exploded view seen from the bottom of the present invention.
Figure 3:
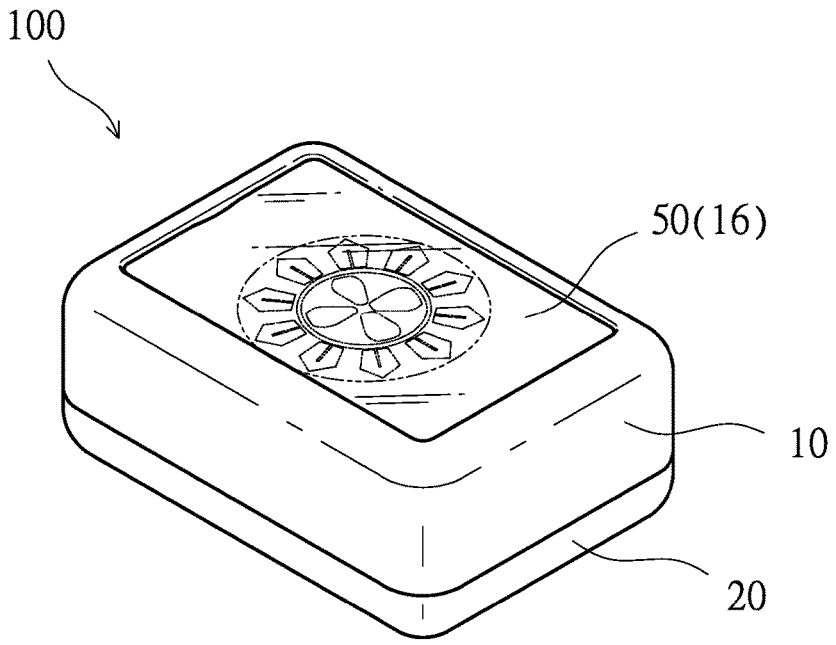
FIG. 3 is a perspective view seen from the bottom of the present invention.

Embodiments of the present invention will now be described, by way of example only, with reference to the accompanying drawings.

As shown in FIG. 1 to FIG. 4, a mahjong tile 100 of the present invention comprises a rectangular main body 10, a cover 20, a magnet 30, an induction chip 40, and a transparent board 50. The main body 10 is provided with grid-like ribs 11. An inner side of the main body 10 is formed with a chip trough 12 having a notch 13. A top surface of the main body 10 is provided with a plurality of protruding connecting studs 14. The main body 10 has an edge groove 15 around a top circumferential portion thereof, a tile face trough 16 at a bottom thereof, and a plurality of side recesses 17 around the tile face trough 16. The cover 20 corresponds in size to the main body 10. A bottom surface of the cover 20 is formed with a plurality of connecting holes 21 corresponding to the connecting studs 14. A central portion of the cover 20 has an accommodation trough 22 arranged same as a long axis direction of the cover 20. The cover 20 further two side troughs 23 at two short sides of the accommodation troughs 22. A bottom of the cover 20 is formed with a lower flange 24 corresponding to the edge groove 15. One side of the cover 20 is provided with a raised press piece 25 corresponding to the notch 13. The magnet 30 is accommodated in the accommodation trough 22. Upper and lower ends of the magnet 30 are magnet poles of the magnet 30. The induction chip 40 is covered with a protection sleeve 41 and inserted in the chip trough 12. A surface of the transparent board 50 has a suit and a numeric thereon. An edge of the transparent board 50 is provided with a plurality of protrusions 51 corresponding to the side recesses 17 for the transparent board 50 to be engaged in the tile face trough 16. Through the aforesaid structure, the cover 20 is to cover the top of the cover 20. The connecting poles 14 are inserted into the connecting holes 21. The flange 24 is engaged with the edge groove 15. The tops of the ribs 11 lean against the magnet 30. The press piece 25 is embedded into the notch 13 to hold against the induction chip 40. The induction chip 40 is used for a sensor to read the suite and numeric of the mahjong tile 100. The magnet 30 of the mahjong tile 100 supplies magnetism, enabling the mahjong tile 100 to be delivered for playing a computer game with the amusement of the real mahjong tile 100. This can prevent the players from touching the tiles and increase the fairness of the game.

The details of the assembly of the present invention are described as below. As shown in FIG. 1 to FIG. 4, the mahjong tile 100 of the present invention is formed by injection, such that the color of the main body 10 and the cover 20 can be changed easily. The side troughs 23 of the accommodation trough 22 are for a machine or an operator to install or take out the magnet 30 conveniently. The protection sleeve 41 is a resilient sleeve to wrap the induction chip 40. The induction chip 40 is positioned in the chip trough 12. When the mahjong tile 100 is shaken or collided, the protection sleeve 41 provides a buffering effect to protect the induction chip 40 from being collided by an external force. The induction chip 40 is uprightly inserted in the chip trough 12 of the main body 10. That is to say, the induction chip 40 is inducted in an upright direction, which is beneficial for induction. The surface of the transparent board 50 is printed with the suite and numeric of the mahjong tile. The transparent board 50 is received and engaged in the tile face trough 16, not protruding out of the bottom surface the main body 10 so as to protect the suite and the numeric of the transparent board 50 from being rubbed off. For different mahjong tile faces, only the transparent board 50 is replaced with one having a different suite and numeric so as to save the cost.

Figure 4:
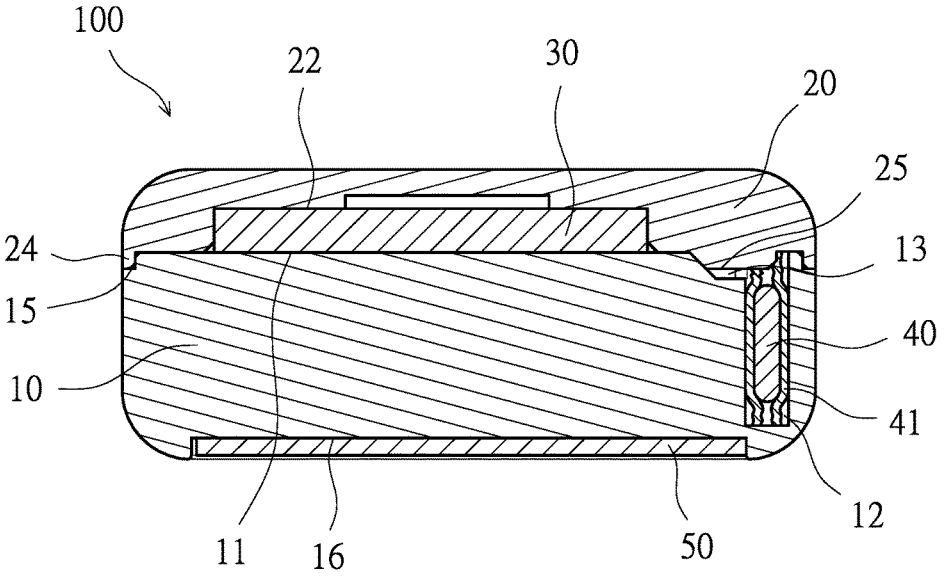
FIG. 4 is a sectional view of the present invention.
Figure 5:
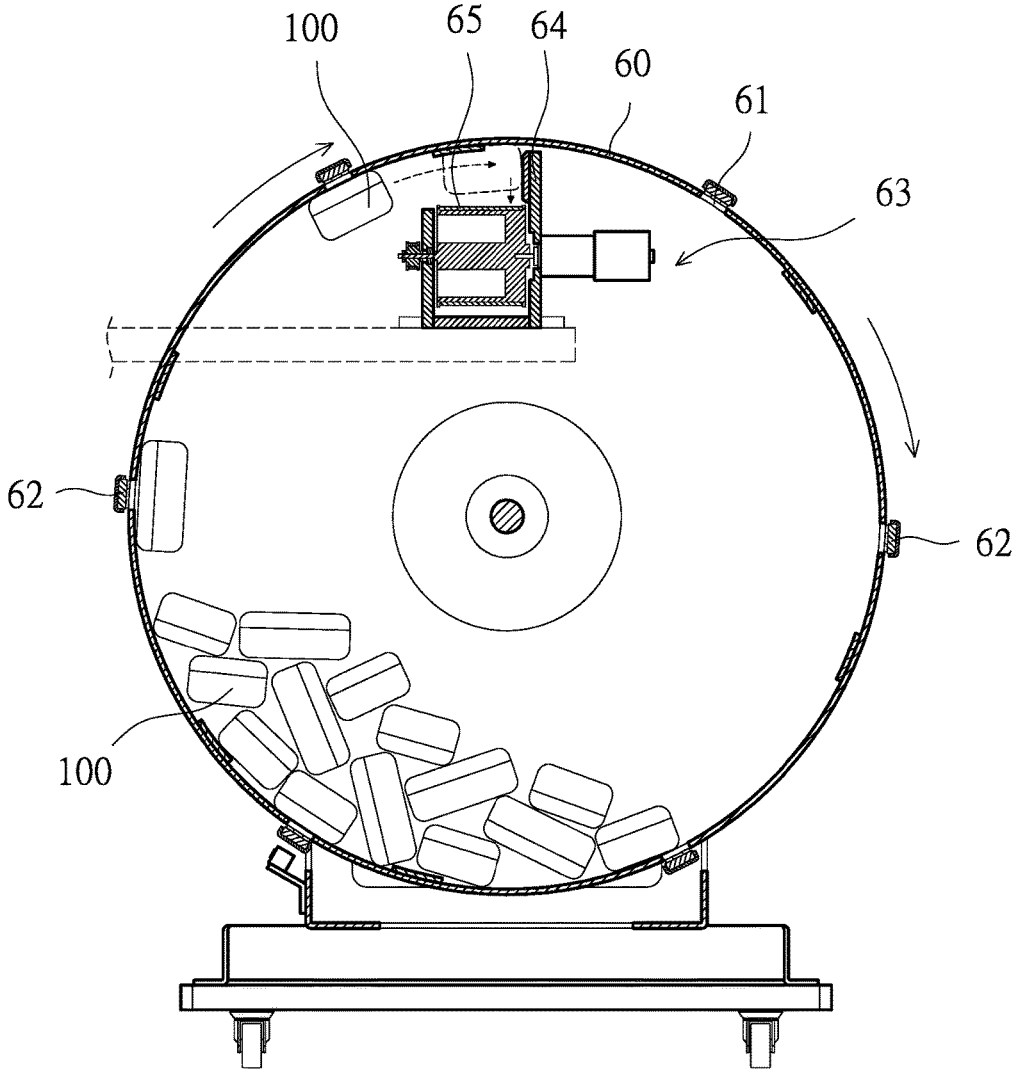
FIG. 5 is a front sectional view of the present invention placed in a rolling cylinder.
Figure 6:
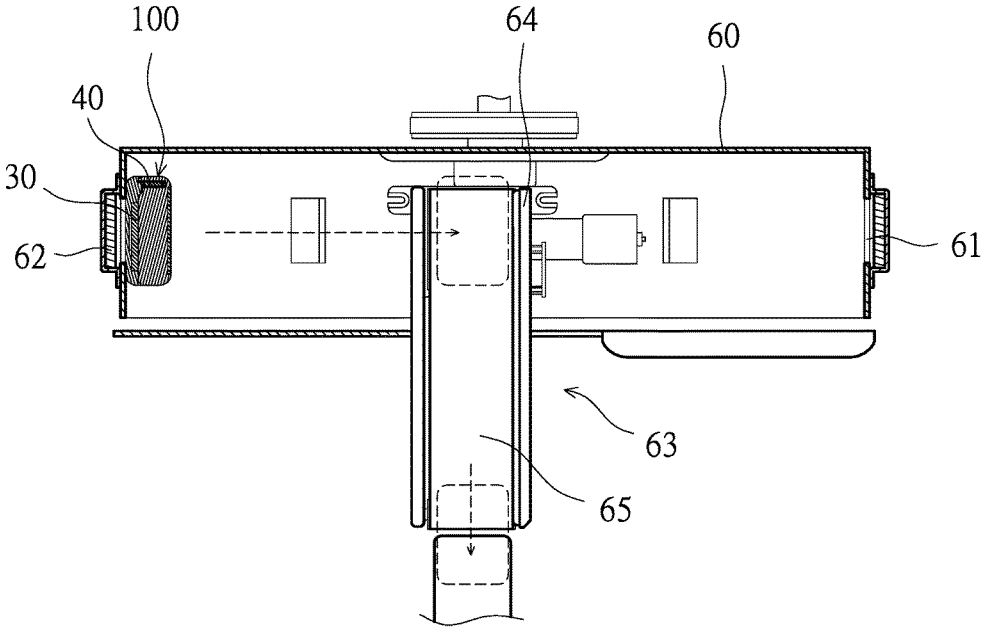
FIG. 6 is a top sectional view of the present invention placed in a rolling cylinder.

Referring to FIG. 4 to FIG. 6, when in use, one set of the mahjong tiles 100 is placed in a rolling cylinder 60. The mahjong tiles 100 are shuffled in the rolling cylinder 60, as shown in FIG. 5. A circumferential surface of the rolling cylinder 60 is formed with a plurality of through holes 61. An outer side of each through hole 61 is provided with a magnet assembly 62. The magnet assembly 62 has a magnetic pole opposite to that of the magnet 30 of the mahjong tile 100, so that the magnet assembly 62 can attract the mahjong tile 100. The rolling cylinder 60 brings the mahjong tile 100 to be turned. When the attracted mahjong tile 100 is in contact with an output mechanism 63 having a stop board 64 and a conveying belt 65 located at the top of the rolling board 60, the mahjong tile 100 will be stopped by the stop board 64 and drop on the conveying belt 65. The conveying belt 65 outputs the mahjong tiles 100 stably for playing a mahjong game.

Referring to FIG. 6, it is worth mentioning that the long axis direction of the magnet assembly 62 corresponds to the axial direction of the rolling cylinder 60, enabling the mahjong tile 100 to face downward when the magnet assembly 62 attracts the mahjong tile 100 and brings it to the top of the rolling cylinder 60. Because the mahjong tile 100 is attracted by the magnet assembly 62 in the long axis direction, it drops on the conveying belt 65 longitudinally.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A mahjong tile, comprising a rectangular main body, a cover, a magnet, an induction chip, and a transparent board; an inner side of the main body being formed with a chip trough, the main body having a tile face trough at a bottom thereof and a plurality of side recesses around the tile face trough, the transparent board being located in the tile face trough, a surface of the transparent board having a suit and a numeric thereon, an edge of the transparent board being provided with a plurality of protrusions corresponding to the side recesses for the transparent board to be engaged in the tile face trough, not protruding out of a bottom surface the main body to protect the suite and the to numeric of the transparent board from being rubbed off; the cover corresponding in size to the main body to cover a top of the main body, a bottom central portion of the cover being formed with an accommodation trough arranged same as a long axis direction of the cover; the magnet being accommodated in the accommodation trough, upper and lower ends of the magnet being magnet poles of the magnet; the induction chip being inserted in the chip trough and covered with a protection sleeve.

2. The mahjong tile as claimed in claim 1, wherein the chip trough has a notch, one side of the cover is provided with a raised press piece corresponding to the notch, and the press piece is engaged in the notch to press against the induction chip.

3. The mahjong tile as claimed in claim 1, wherein the cover further two side troughs at two short sides of the accommodation troughs.

4. The mahjong tile as claimed in claim 1, wherein a top surface of the main body is provided with a plurality of protruding connecting studs, a bottom surface of the cover is formed with a plurality of connecting holes corresponding to the connecting studs, and the connecting studs are inserted into the connecting holes.

5. The mahjong tile as claimed in claim 4, wherein the main body has an edge groove around a top circumferential portion thereof, a bottom of the cover is formed with a lower flange corresponding to the edge groove, and the lower flange is engaged with the edge groove.

6. The mahjong tile as claimed in claim 4, wherein the main body is provided with grid-like ribs therein, and tops of the ribs lean against the magnet.

* * * * *